US008408923B2

(12) United States Patent
Tay et al.

(10) Patent No.: US 8,408,923 B2
(45) Date of Patent: Apr. 2, 2013

(54) DIELECTRIC PART AND AN ELECTRICAL CONNECTOR ASSEMBLY INCORPORATING THE SAME

(75) Inventors: Hong Chuan Tay, Singapore (SG); Michael Yash, Milford, MI (US)

(73) Assignee: J. S. T. Corporation, Farmington Hills, MI (US)

( * ) Notice: Subject to any disclaimer, the term of this patent is extended or adjusted under 35 U.S.C. 154(b) by 146 days.

(21) Appl. No.: 12/869,031

(22) Filed: Aug. 26, 2010

(65) Prior Publication Data

US 2012/0052696 A1 Mar. 1, 2012

(51) Int. Cl.
*H01R 12/00* (2006.01)

(52) U.S. Cl. ..... 439/79

(58) Field of Classification Search ..... 439/78, 439/79, 272, 892

See application file for complete search history.

(56) References Cited

U.S. PATENT DOCUMENTS

| | | | | |
|---|---|---|---|---|
| 3,793,720 | A * | 2/1974 | Van Rijsewijk et al. | 29/837 |
| 4,533,188 | A * | 8/1985 | Miniet | 439/77 |
| 4,722,691 | A * | 2/1988 | Gladd et al. | 439/79 |
| 4,950,170 | A * | 8/1990 | Miller, Jr. | 439/74 |
| 4,986,772 | A * | 1/1991 | Fukutani | 439/892 |
| 5,015,946 | A * | 5/1991 | Janko | 324/750.25 |
| 5,078,626 | A * | 1/1992 | Matsuoka et al. | 439/892 |
| 6,171,133 | B1 * | 1/2001 | Altuner et al. | 439/381 |
| 2004/0235361 | A1 | 11/2004 | Cao | |
| 2007/0167035 | A1 | 7/2007 | Duke | |

FOREIGN PATENT DOCUMENTS

| | | |
|---|---|---|
| BE | 1 009 803 A3 | 8/1997 |
| EP | 0 138 368 A2 | 4/1985 |

OTHER PUBLICATIONS

International Search Report issued Jul. 28, 2011 for corresponding PCT No. PCT/US2011/040522.

* cited by examiner

*Primary Examiner* — Phuong Dinh
(74) *Attorney, Agent, or Firm* — Rader, Fishman & Grauer PLLC

(57) ABSTRACT

A dielectric part is used with an electrical connector housing and a matable connector piece such as a printed circuit board. The electrical connector housing has a plurality of terminal pins secured therein with terminal pin portions extending from the electrical connector housing. The dielectric part includes a box-shaped dielectric part body that is fabricated from a stiff yet resilient dielectric material and has a plurality of dielectric part body holes sized and arranged to slidably receive the terminal pin portions. When the electrical connector housing and the matable connector piece are releasably connected together, the dielectric part body is disposed between the electrical connector housing and the matable connector piece and the terminal pin portions are slidably received in the plurality of dielectric part body holes thereby being enveloped by the dielectric part body to isolate the terminal pin portions from one another. An electrical assembly is also described.

14 Claims, 16 Drawing Sheets

DIELECTRIC PART AND AN ELECTRICAL CONNECTOR ASSEMBLY INCORPORATING THE SAME

FIELD OF THE INVENTION

The present invention relates to a dielectric part adapted for use with an electrical connector assembly.

BACKGROUND OF THE INVENTION

Electrical connector assemblies are well known in the art and are used in many industries. As an example, the automobile industry uses electrical connector assemblies. In the past, performance requirements for electrical connector assemblies were not very demanding because, in older vehicles, these electrical connector assemblies carried low voltage and/or low amperage. In modern vehicles, higher performance requirements for electrical connector assemblies are now demanded. Modern vehicles use electrical connector assemblies not only for the operation of the vehicle itself but also for equipment ancillary to its operation. Ancillary equipment includes entertainment equipment such as high fidelity stereo equipment and liquid crystal television screens for passenger enjoyment. As a result, the electrical connector assemblies must now carry higher voltages and/or higher amperage.

An electrical connector assembly includes an electrical connector housing and a plurality of terminal pins arranged in a juxtaposed manner to one another. Electrical connector assemblies are often molded using plastic as the mold material. When removed from the mold, one portion of each terminal pin is enveloped by molded plastic to secure the terminal pins in the electrical connector housing and another portion of each terminal pin projects from a generally flat surface of the electrical connector housing.

By way of example, the electrical connector assembly can be mounted onto a printed circuit board. The plurality of terminal pins extends though a pattern of holes in the printed circuit board that comports with the arrangement of the terminal pins. The generally flat surface of the connector housing contacts the flat printed circuit board. Unfortunately, a small gap might be formed between the generally flat surface of the electrical connector housing and the printed circuit board. It is theorized that this small gap is created because the molding process used to make the electrical connector assembly renders an electrical connector housing with imprecise dimensional characteristics. This is an inherent problem with plastic molding.

In this small gap, juxtaposed ones of the terminal pins are exposed to one another in an open-air environment. Being in this small gap, electrical arching might occur between these juxtaposed ones of the terminal pins resulting in detrimental effects to the electrical circuit. Now, with electrical connector assemblies being designed to carry higher voltage and/or higher amperage, it is believed that the incidence of electrical arching might increase.

To mitigate electrical arching between juxtaposed ones of the terminal pins in this open-air environment, a conformal coating is applied between the generally flat surface of the electrical connector housing and the printed circuit board to fill the small gap. As a result, the juxtaposed terminal pins are now considered isolated from one another thereby improving the dielectric characteristics of the electrical connector assembly mounted onto the printed circuit board in order to mitigate electrical arching.

It would be beneficial to provide a dielectric component for an electrical connector assembly in order to enhance the dielectric characteristics of the electrical connector assembly. It would also be beneficial to provide a dielectric component for the electrical connector assembly to mitigate electrical arching between juxtaposed ones of terminal pins projecting from an electrical connector housing without using conformal coating. The present invention provides these benefits.

OBJECTS AND SUMMARY OF THE INVENTION

It is an object of the invention to provide a dielectric part for an electrical connector assembly to enhance its dielectric characteristics.

It is another object of the invention to provide a dielectric part for the electrical connector assembly to mitigate electrical arching between juxtaposed ones of terminal pins projecting from an electrical connector housing without using conformal coating.

Accordingly, one exemplary embodiment of a dielectric part of the present invention is hereinafter described. The dielectric part is adapted for use with an electrical connector housing and a matable connector piece. The electrical connector housing has a plurality of terminal pins secured therein with terminal pin portions extending from the electrical connector housing. The dielectric part includes a box-shaped dielectric part body that is fabricated from a stiff yet resilient dielectric material and has a plurality of dielectric part body holes sized and arranged to slidably receive respective ones of the terminal pin portions. When the electrical connector housing and the matable connector piece are releasably connected together, the dielectric part body is disposed between at least a portion of the electrical connector housing and the matable connector piece and respective ones of the terminal pin portions are slidably received in respective ones of the plurality of dielectric part body holes thereby being enveloped by the dielectric part body to isolate the terminal pin portions from one another and end sections of the terminal pin portions extend through and project from the matable connector piece.

Another exemplary embodiment is a dielectric part that includes the box-shaped dielectric part body that is fabricated from a stiff yet resilient dielectric material and has a first dielectric part body surface and an opposite second dielectric part body second surface extending parallel to the first dielectric part body surface. The dielectric part body has a plurality of dielectric part body holes extending through and between the first dielectric part body surface and the second dielectric part body surface. A plurality of projections are connected to and project from at least one of the first and second dielectric part body surfaces. Respective ones of the plurality of projections surround respective ones of the dielectric part body holes.

Yet another embodiment of the present invention is an electrical assembly that includes the matable connector piece, the electrical connector housing and the dielectric part. The dielectric part moves to and between a normally relaxed state and a compressed state with the dielectric part being resiliently biased towards the normally relaxed state and, when the electrical connector housing and the matable connector piece are connected together, the dielectric part moves from the normally relaxed state to the compressed state.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

Figure 16:
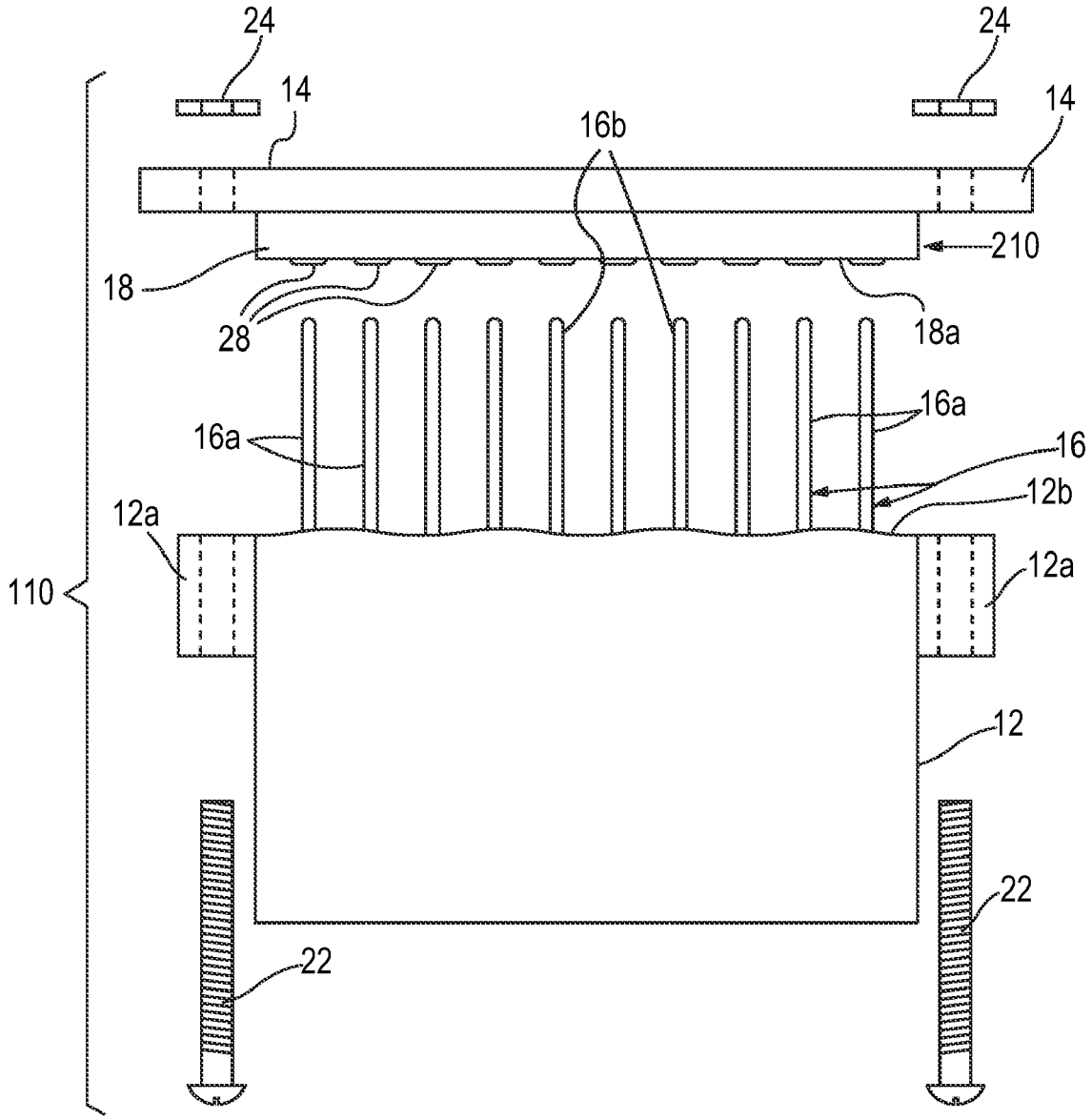
FIG. 16 is a diagrammatical view of an electrical connector assembly with the electrical connector housing, the printed circuit board and the second exemplary embodiment of the dielectric part disposed therebetween and aligned for connecting the same together and with the dielectric part being in a normally relaxed state.
Figure 17:
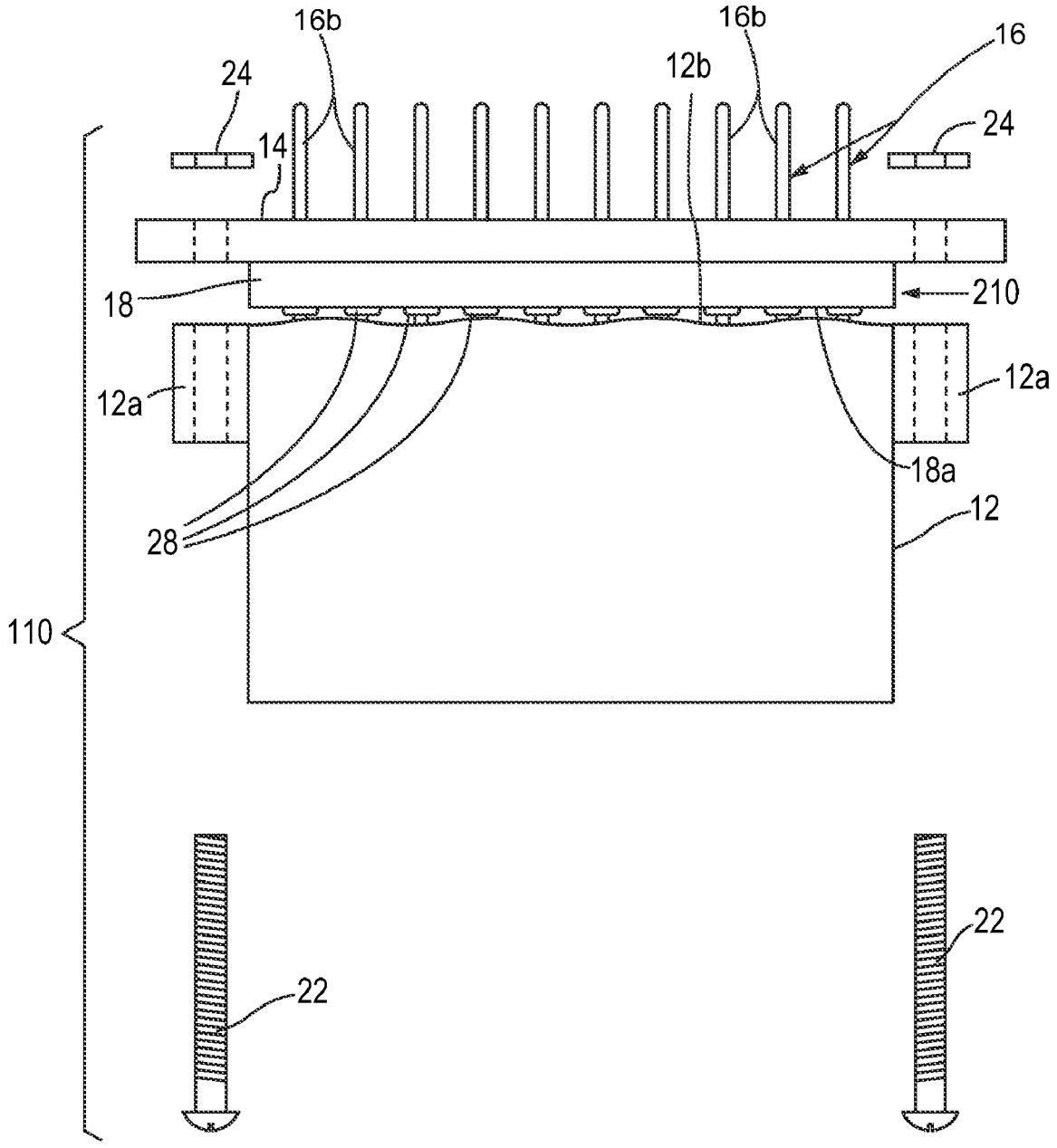
FIG. 17 is a diagrammatical view of the electrical connector assembly with the electrical connector housing, the printed circuit board and the second exemplary embodiment of the dielectric part disposed therebetween and in contact with both the electrical connector housing and the printed circuit board aligned for connecting the same together and with the dielectric part being in the normally relaxed state.

A first exemplary embodiment of a dielectric part 10 of the present invention is hereinafter described with reference to FIGS. 1-9. As best shown in FIGS. 5-9, the dielectric part 10 is adapted for use with an electrical connector housing 12 and a matable connector piece 14 such as a printed circuit board as illustrated herein by way of example only. The electrical connector housing 12 has a plurality of terminal pins 16 that are secured in the electrical connector housing 12. Also, each one of the plurality of terminal pins 16 includes terminal pin portions 16*a* that, as best illustrated in FIG. 16, extend from the electrical connector housing 12.

Figure 8:
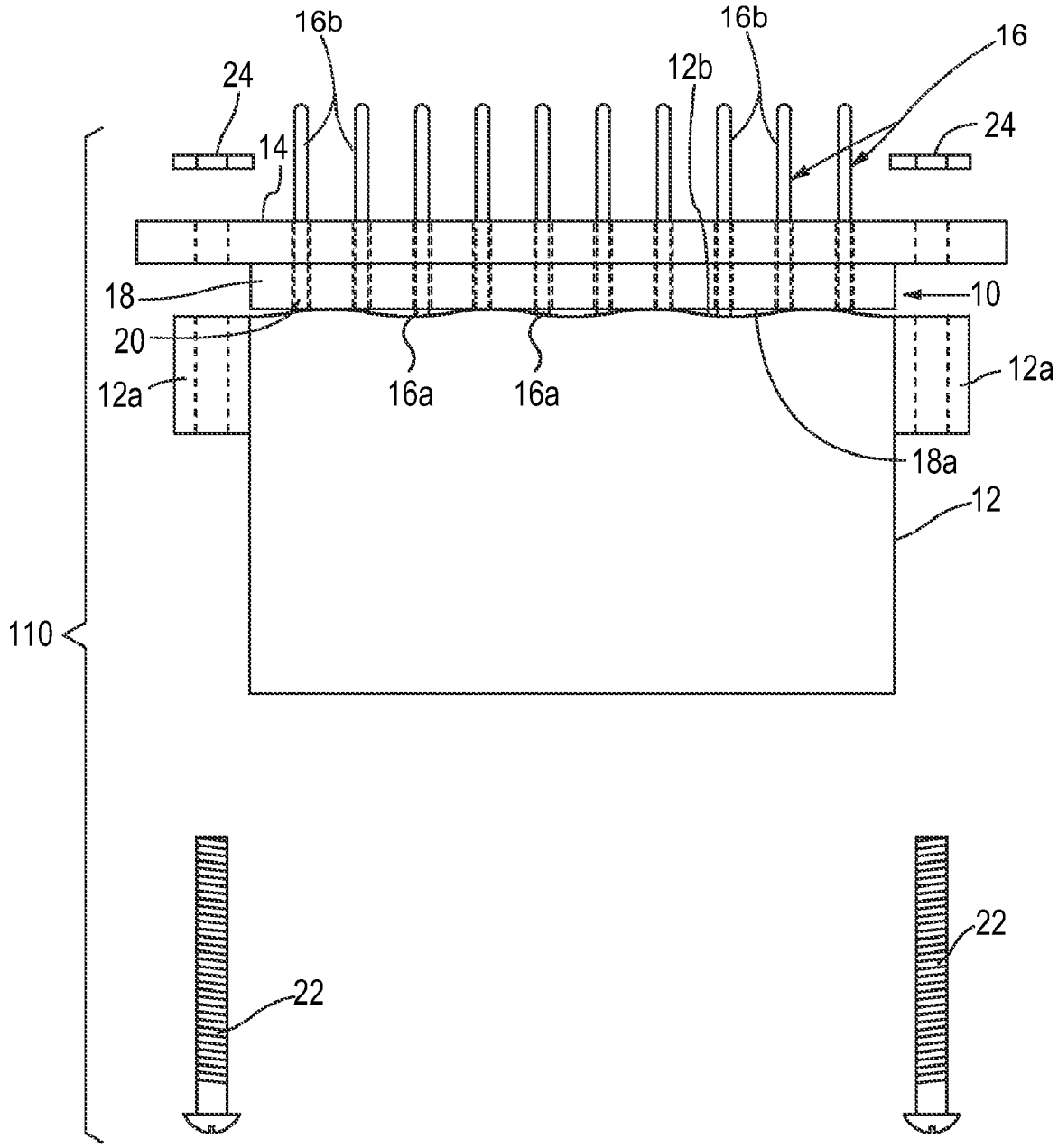
FIG. 8 is a diagrammatical view of the electrical connector assembly shown in FIG. 5 with the electrical connector housing, the printed circuit board and the first exemplary embodiment of the dielectric part disposed therebetween and in contact with both the electrical connector housing and the printed circuit board aligned for connecting the same together and with the dielectric part being in the normally relaxed state.
Figure 9:
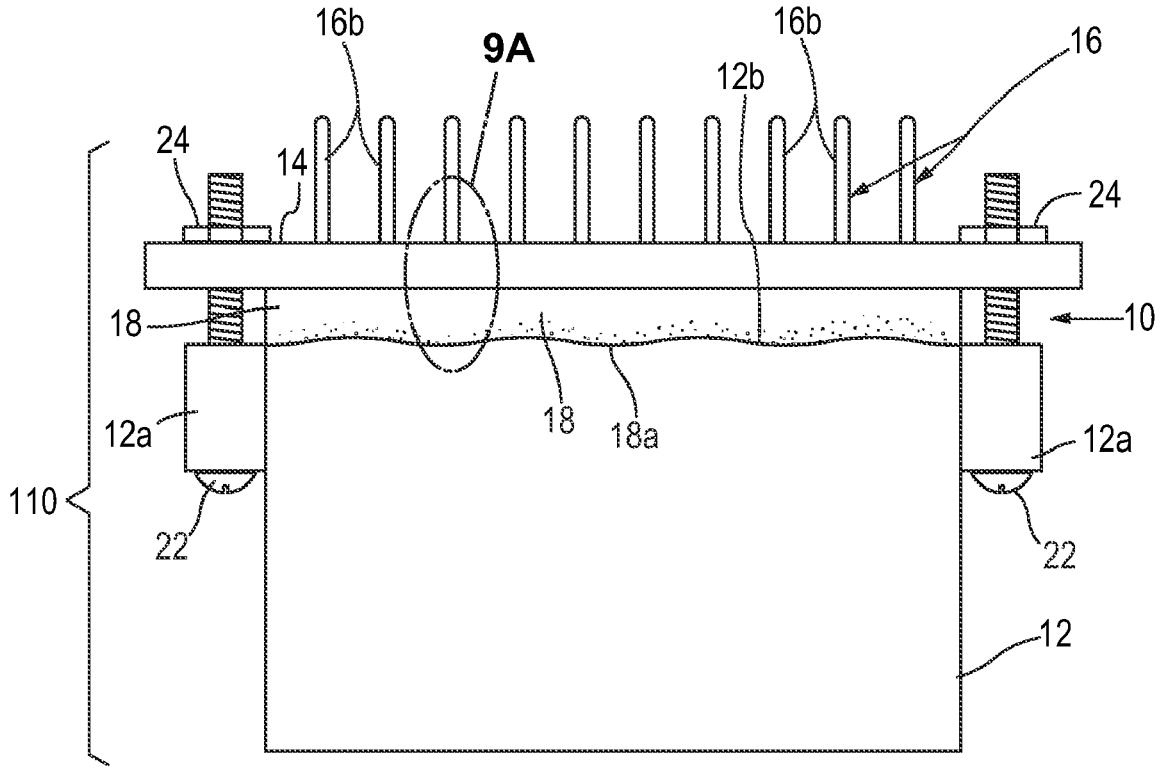
FIG. 9 is a diagrammatical view of the electrical connector assembly shown in FIG. 5 with the electrical connector housing, the printed circuit board and the first exemplary embodiment of the dielectric part in the disposed therebetween connected together and with the dielectric part being in a compressed state.
Figure 9A:
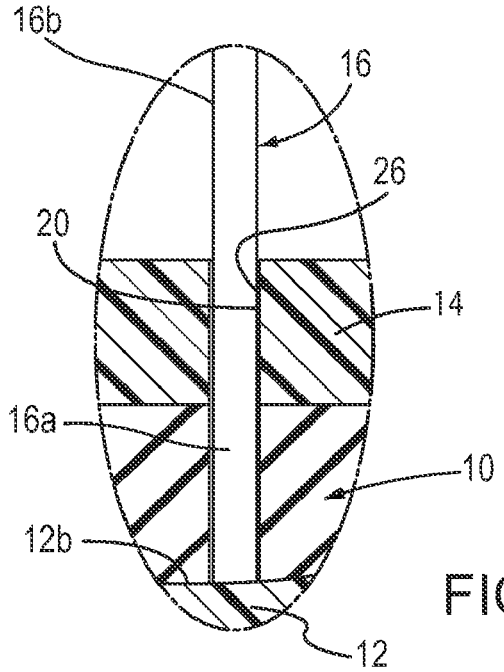
FIG. 9A is an enlarged partial view shown in cross-section taken from the ellipse labeled 9A in FIG. 9.
Figure 10:
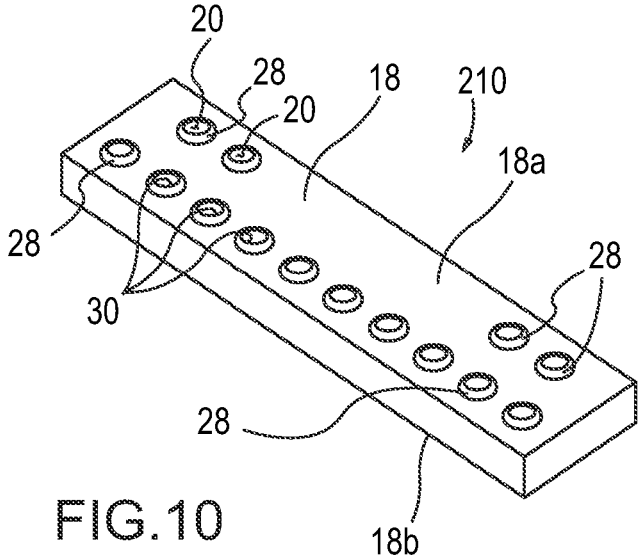
FIG. 10 is a perspective view of a second exemplary embodiment of the dielectric part of the present invention.
Figure 11:
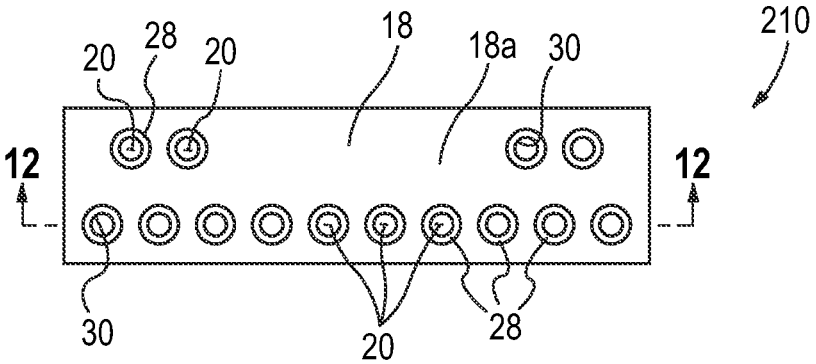
FIG. 11 is a top plan view of the second exemplary embodiment of the dielectric part of the present invention illustrated in FIG. 10.
Figure 13:
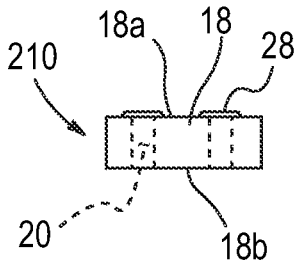
FIG. 13 is a side elevation view of the second exemplary embodiment of the dielectric part of the present invention illustrated in FIG. 10.
Figure 12:
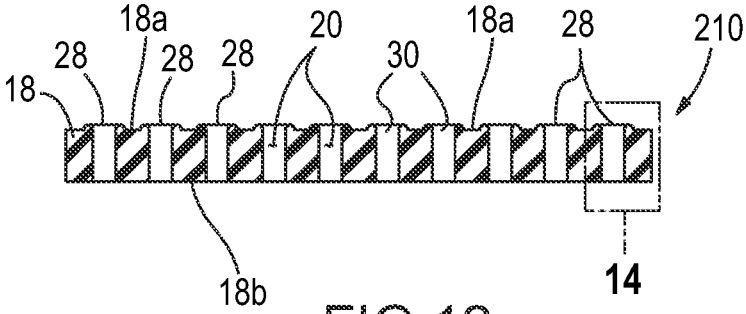
FIG. 12 is a front elevation view in cross-section of the second exemplary embodiment of the dielectric part of the present invention illustrated in FIG. 10.

In FIGS. 1-4, the dielectric part 10 includes a box-shaped dielectric part body 18 that is fabricated from a stiff yet resilient dielectric material (FIG. 3) such as natural rubber, silicone or any other conventional dielectric material having stiff yet resilient properties. The dielectric part body 18 has a plurality of dielectric part body holes 20. Respective ones of the plurality of dielectric part body holes 20 are sized and arranged to slidably receive respective ones of the terminal pin portions 16*a* as illustrated in FIGS. 8, 9A and 9. As such, when the electrical connector housing 12 and the printed circuit board 14 are releasably connected together (FIG. 9), the dielectric part body 18 is disposed between the electrical connector housing 12 or at least a portion of the electrical connector housing 12 and the printed circuit board 14. In this way, respective ones of the terminal pin portions 16*a* are slidably received in respective ones of the plurality of dielectric part body holes 20 and thereby the plurality of terminal pin portions 16*a* are enveloped by the dielectric part body 18 in order to isolate the terminal pin portions 16*a* from one another. Further, note in FIGS. 8, 9A and 9, that end sections 16*b* of the terminal pin portions 16*a* extend through and project from the printed circuit board 14.

One of ordinary skill in the art would appreciate that the dielectric part body 18 and the printed circuit board 14 can be releasably connected together in any conventional manner. One such conventional manner is depicted in FIG. 9 where eyelet elements 12*a* integrally formed with the electrical connector housing 12 receive conventional threaded bolts 22 that extend through the printed circuit board 14 and are fastened thereto with conventional threaded nuts 24. Furthermore, as best shown in FIG. 9A, the plurality of dielectric part body holes 20 are sized to slidably receive the respective ones of the terminal pin portions 16*a* in a close-fitting relationship.

Figure 1:
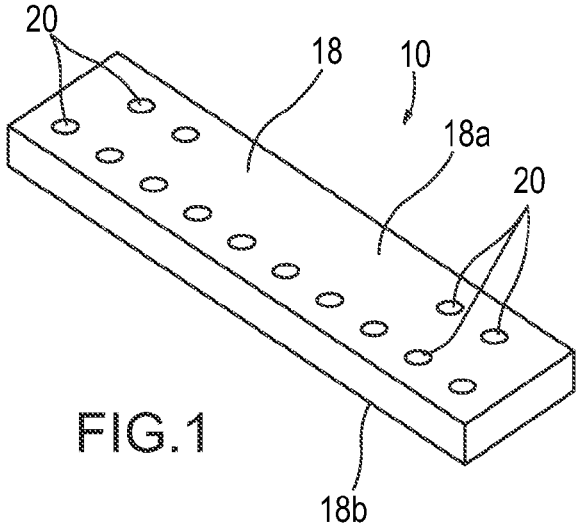
FIG. 1 is a perspective view of a first exemplary embodiment of a dielectric part of the present invention.
Figure 2:
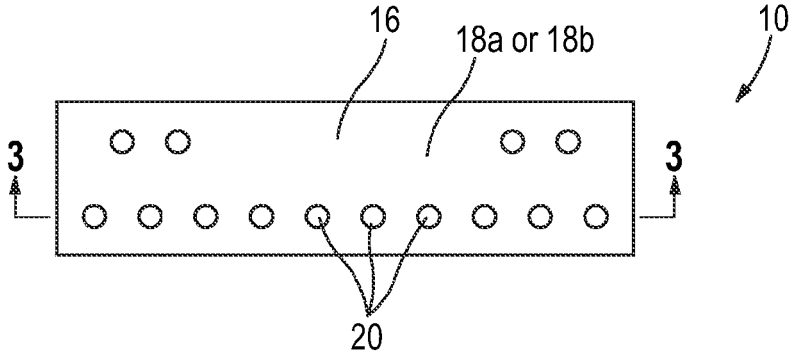
FIG. 2 is a top or bottom plan view of the first exemplary embodiment of the dielectric part of the present invention illustrated in FIG. 1.
Figure 3:
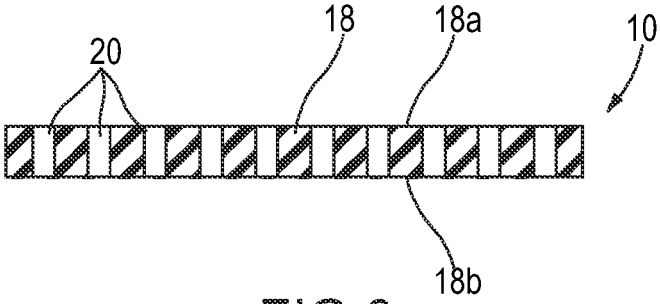
FIG. 3 is a front elevation view in cross-section of the first exemplary embodiment of the dielectric part of the present invention illustrated in FIG. 1.
Figure 4:
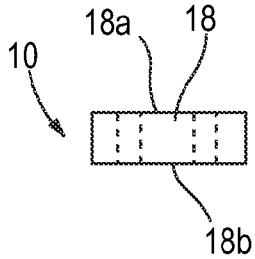
FIG. 4 is a side elevation view of the first exemplary embodiment of the dielectric part of the present invention illustrated in FIG. 1.
Figure 5:
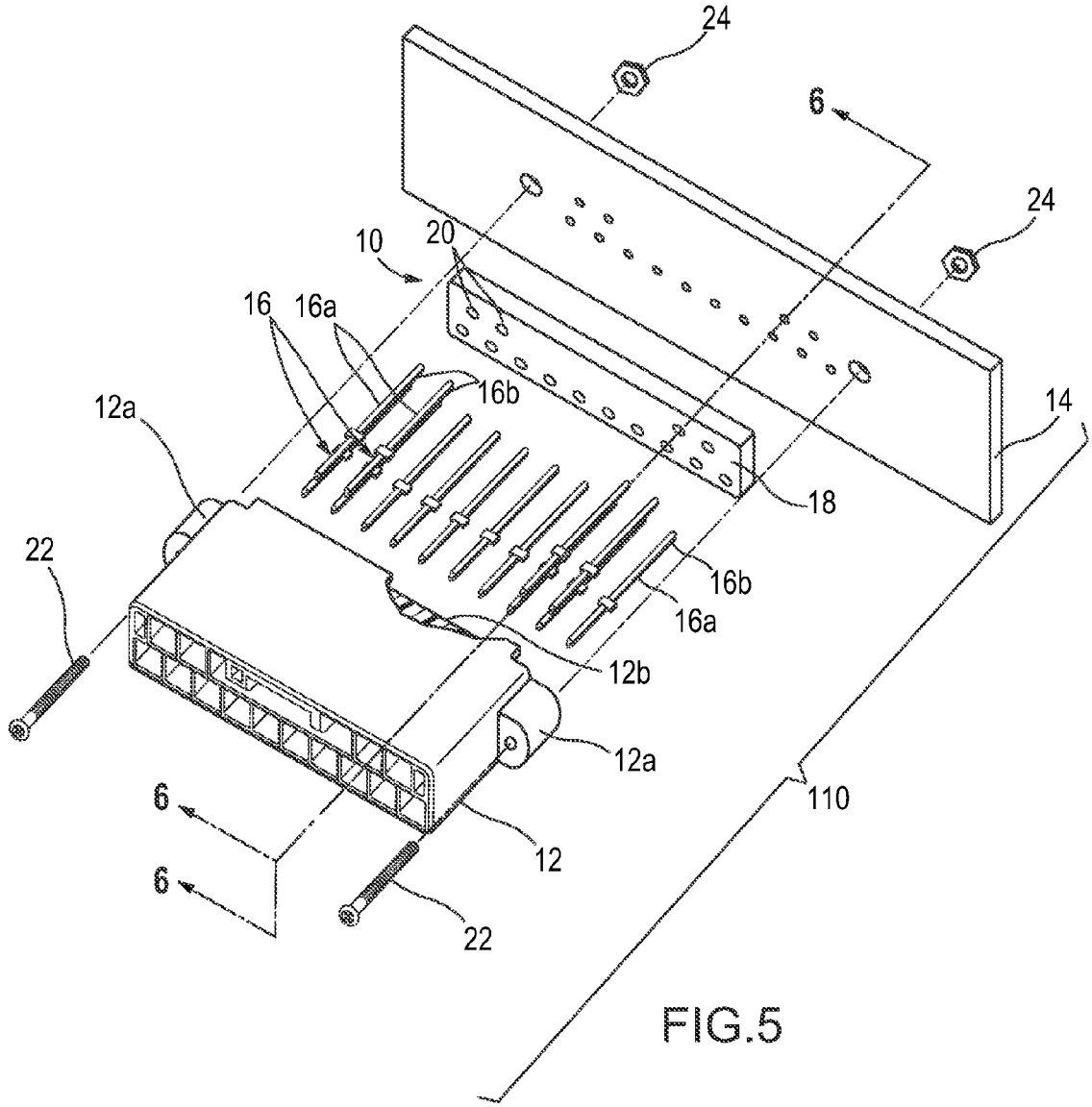
FIG. 5 is an exploded perspective view of an electrical connector assembly that includes the first exemplary embodiment of the dielectric part of the present invention, an electrical connector housing with a plurality of terminal pins and a printed circuit board.
Figure 6:
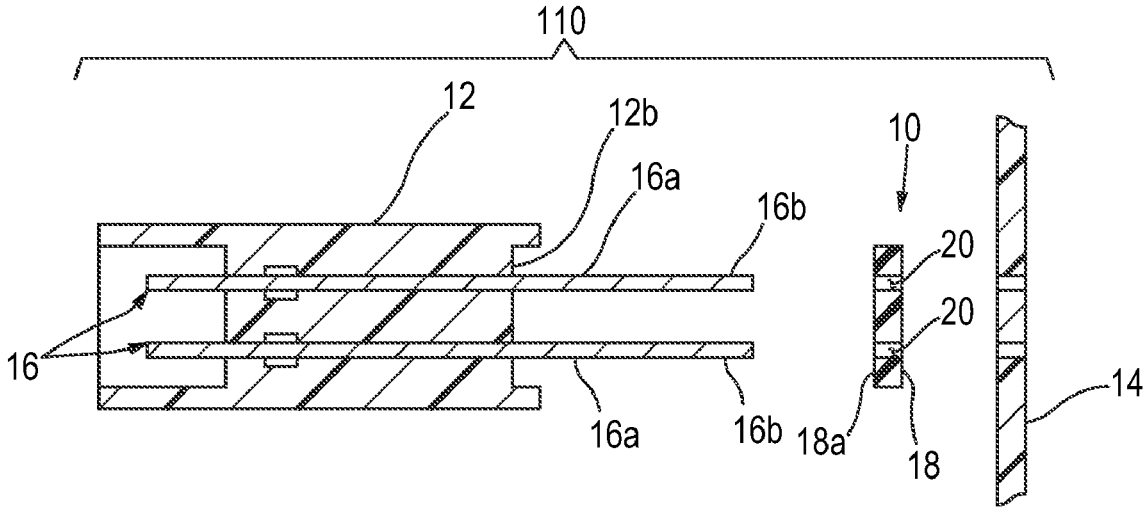
FIG. 6 is a partially exploded side elevation view in cross-section of the electrical connector assembly shown in FIG. 5 with the plurality of terminal pins secured in the electrical connector housing.

As best illustrated in FIGS. 1-4, the dielectric part body 18 has a first dielectric part body surface 18*a* and an opposite second dielectric part body second surface 18*b*. The second dielectric part body surface 18*b* extends parallel to the first dielectric part body surface 18*a*. As best shown in FIG. 3, the dielectric part body holes 20 extend through and between the first dielectric part body surface 18*a* and the second dielectric part body surface 18*b*.

Figure 7:
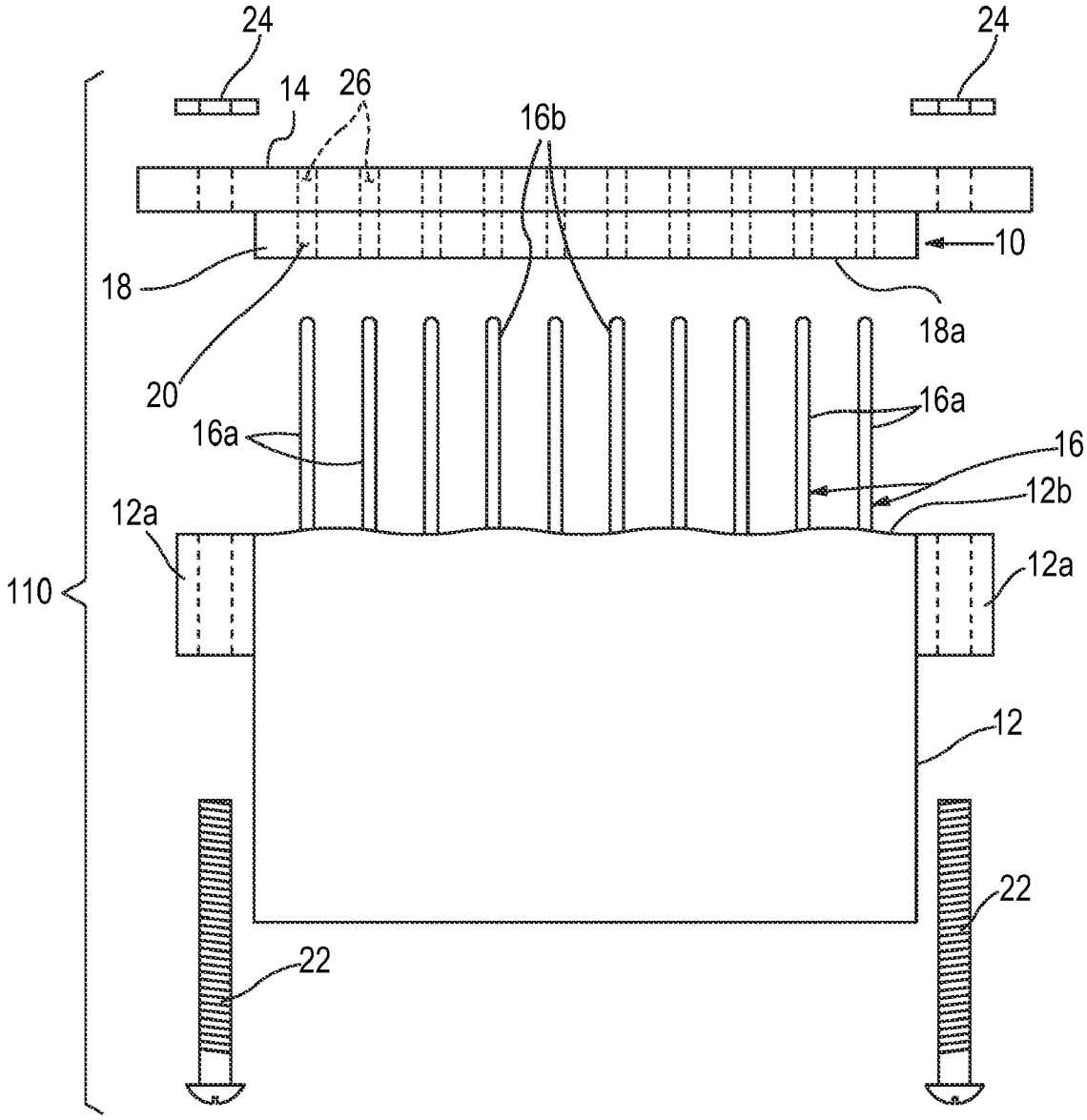
FIG. 7 is a diagrammatical view of the electrical connector assembly shown in FIG. 5 with the electrical connector housing, the printed circuit board and the first exemplary embodiment of the dielectric part disposed therebetween and aligned for connecting the same together and with the dielectric part being in a normally relaxed state.

FIGS. 5-9 illustrate in series how the dielectric part 10, the electrical connector housing 12 and the printed circuit board 14 are connected together to form an electrical connector assembly 110. As shown in FIGS. 5-9, the terminal pins 16 project from an electrical connector housing surface 12*b*. As is known in the art, the electrical connector housing surface 12*b* is not often formed as being perfectly flat. In order to best illustrate the invention, the electrical connector housing surface 12*b* is drawn in an overly-exaggerated, uneven manner (FIGS. 7-9) for illustration purposes only to best explain the operation of the invention. As commonly known in the art, both the dielectric part body holes 20 and printed circuit board holes 26 as best depicted in FIGS. 7, 9 and 9A are arranged in a pattern to slidably receive the plurality of the terminal pin portions 16*a* also arranged in that pattern.

In FIGS. 7 and 8, the dielectric part is in a normally relaxed state and, in FIGS. 9 and 9A, the dielectric part is in a compressed state. When in the compressed state, the dielectric part 10 is resiliently biased towards the normally relaxed state. As the electrical connector housing 12 and the printed circuit board 14 move towards each other with the dielectric part 10 disposed therebetween, the dielectric part 10 is in the normally relaxed state as shown in FIGS. 7 and 8. As the electrical connector housing 12 and the printed circuit board 14 are connected together with the dielectric part 10 part moves to and between a normally relaxed state and a compressed state with the dielectric part 10 being resiliently biased towards the normally relaxed state. And, when the electrical connector housing 12 and the printed circuit board 14 are connected together with the dielectric part 10 disposed therebetween, the dielectric part 10 moves from the normally relaxed state (FIGS. 7 and 8) to the compressed state (FIG. 9). Note in FIG. 9 that the first dielectric part body surface 18*a* conforms to the uneven electrical connector housing surface 12*b*. As a result, all of the terminal pin portions 16*a* that are enveloped by the dielectric part 10 are electrically and physically isolated from one another thereby reducing the possibility of electrical arching during operations.

In summary and with reference to FIGS. 7-9 in series, when the electrical connector housing 12 and the printed circuit board 14 are releasably connected together, the dielectric part body 10 is disposed between at least a portion of the electrical connector housing 12 and the printed circuit board 14 and respective ones of the terminal pin portions 16*a* are slidably received in respective ones of the plurality of dielectric part body holes 20. As a result, the terminal pin portions 16*a* are enveloped by the dielectric part body 18 to isolate the terminal pin portions 16*a* from one another and the end sections 16*b* of the terminal pin portions 16*a* extend through and project from the printed circuit board 14 (FIGS. 9A and 9).

A second embodiment of a dielectric part 210 of the present invention is introduced in FIGS. 10-18. The dielectric part 210 is similar to the dielectric part 10 of the present invention discussed above. One difference is that the dielectric part 210 includes a plurality of projections 28. The plurality of projections 28 are connected to and project from the first and second dielectric part body surface 18*a*. However, one of ordinary skill in the art would appreciate that the plurality of projections 28 can be connected to and project from the second dielectric part body surface 18*a* without departing from the spirit of the invention.

Figure 14:
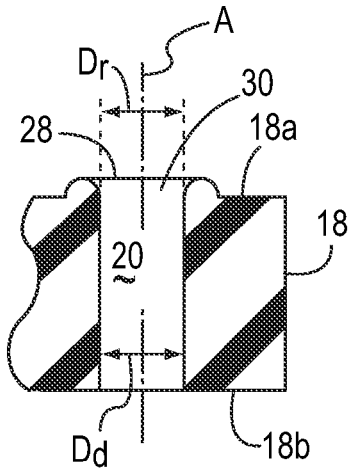
FIG. 14 is an enlarged partial view of an end portion of the second exemplary embodiment of the dielectric part taken from the dashed box 14 in FIG. 12.
Figure 15:
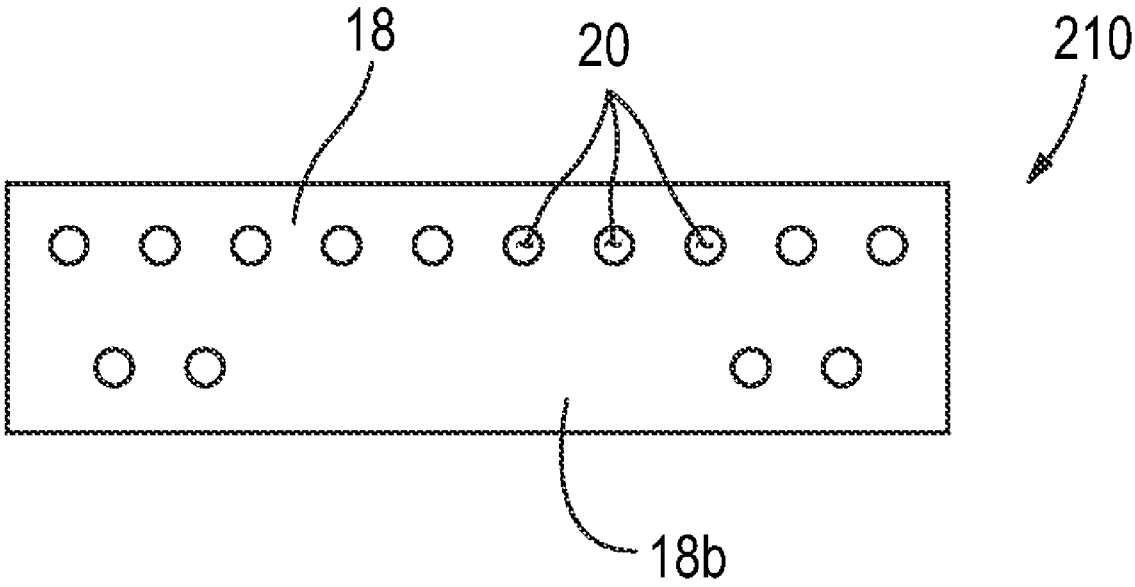
FIG. 15 is a bottom plan view of the second exemplary embodiment of the dielectric part of the present invention illustrated in FIG. 10.

As best shown in FIGS. 10-14, respective ones of the plurality of projections 28 surround respective ones of the dielectric part body holes 20. For the second exemplary embodiment of the dielectric part 210, each one of the plurality of projections 28 is ring-shaped and defines an inner ring-shaped projection hole 30 as best shown in FIG. 14. Also, with reference to FIG. 14, each one of the dielectric part body holes 20 has a dielectric part body hole diameter Dd and each one of the ring-shaped projection holes 30 has an inner ring-shaped projection hole diameter Dr which is equal to the dielectric part body hole diameter Dd. Also, in FIG. 14, respective ones of the dielectric part body holes 20 and respective ones of the inner ring-shaped projection holes 30 axially align with one another along axis A.

Although not by way of limitation but by example only, the dielectric part body 18 and the plurality of the ring-shaped projections 28 are formed as an integral construction. As best viewed in FIGS. 10-14, each one of the ring-shaped projections 28 is arcuately shaped as shown in cross-section. These ring-shaped projections 28 could also be considered as donut shaped.

Figure 18:
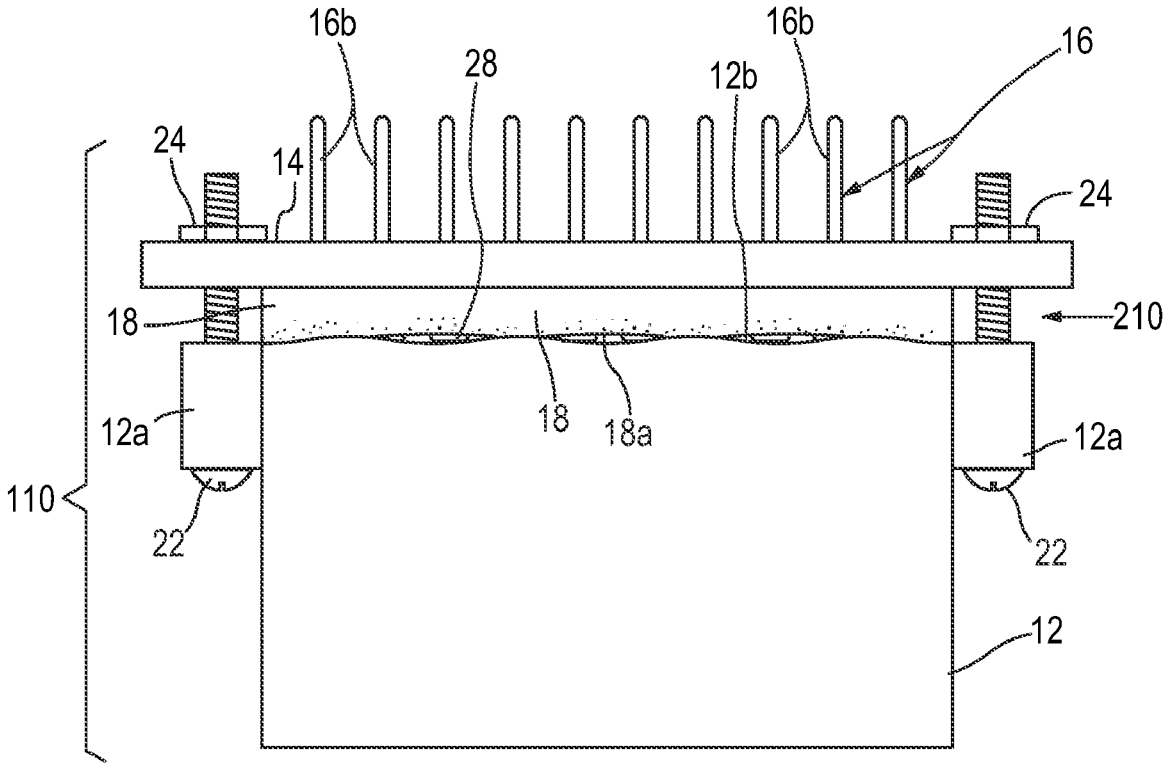
FIG. 18 is a diagrammatical view of the electrical connector assembly with the electrical connector housing, the printed circuit board and the second exemplary embodiment of the dielectric part disposed therebetween and connected together and with the dielectric part being in the compressed state.
Figure 19:
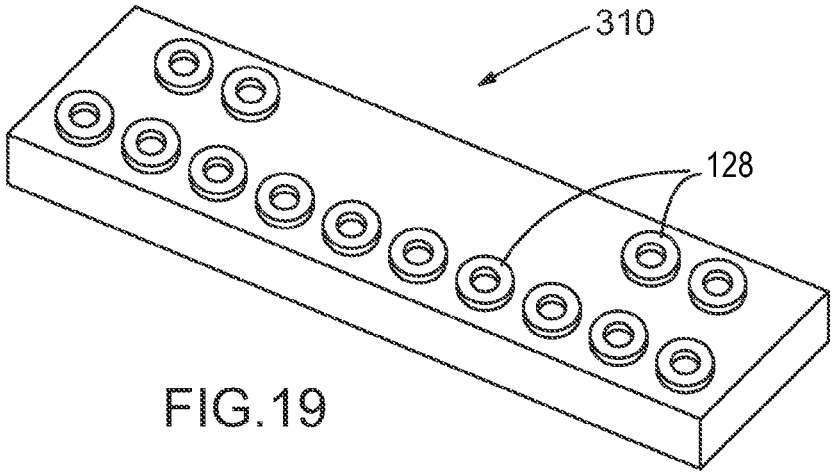
FIG. 19 is a perspective view of a third exemplary embodiment of the dielectric part of the present invention.
Figure 20:
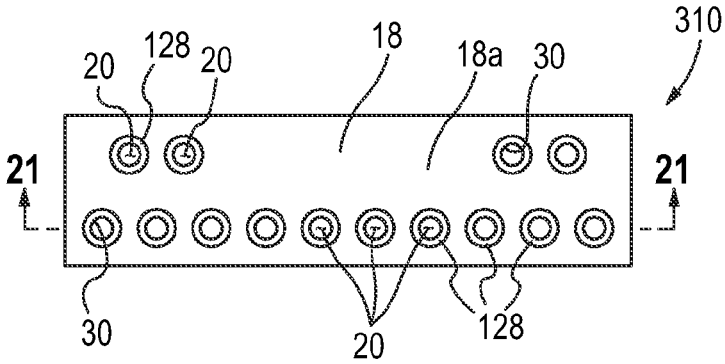
FIG. 20 is a top plan view of the third exemplary embodiment of the dielectric part of the present invention illustrated in FIG. 19.
Figure 22:
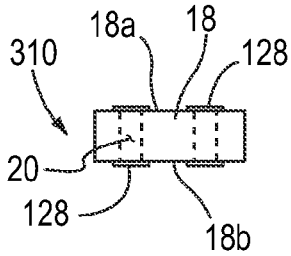
FIG. 22 is a side elevation view of the third exemplary embodiment of the dielectric part of the present invention illustrated in FIG. 19.
Figure 21:
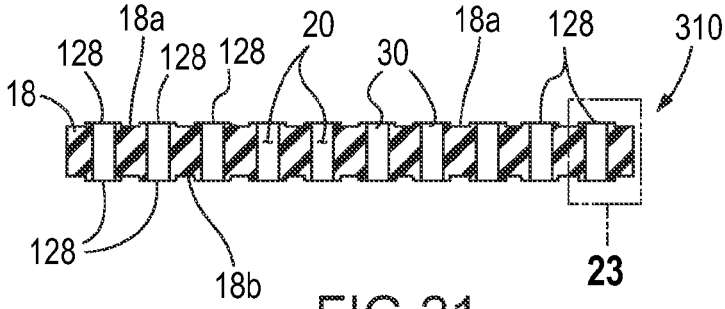
FIG. 21 is a front elevation view in cross-section of the third exemplary embodiment of the dielectric part of the present invention illustrated in FIG. 19.
Figure 23:
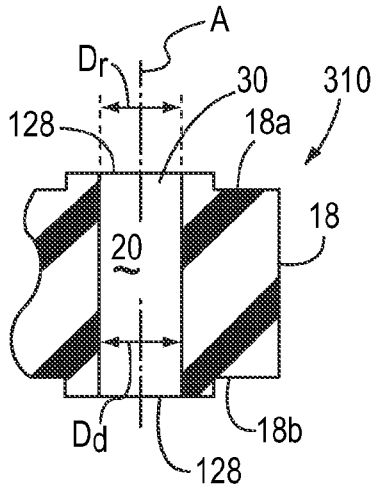
FIG. 23 is an enlarged partial view of an end portion of the third exemplary embodiment of the dielectric part taken from the dashed box 23 in FIG. 21.

FIGS. 16-19 illustrate in series how the dielectric part 210, the electrical connector housing 12 and the printed circuit board 14 are connected together to form the electrical connector assembly 110 similar to FIGS. 6-9 describe above. As shown in FIG. 19, the plurality of the ring-shaped projections 28 are compressed with the dielectric part body 18. Although not by way of limitation but by example only and as shown in FIG. 18, the entirety of the first dielectric part body surface 18*a* is only partially contacted by the electrical connector housing surface 12*b* and contact is made by the electrical connector housing surface 12*b* with the plurality of ring-shaped projections 28. Again, in order to best illustrate the invention, the electrical connector housing surface 12*b* is drawn in an overly-exaggerated, uneven manner (FIGS. 16-187-9) for illustration purposes only to best explain the operation of the invention. As commonly known in the art, both the dielectric part body holes 20 and printed circuit board holes 26 as best depicted in FIGS. 7, 9 and 9A are arranged in a pattern to slidably receive the plurality of the terminal pin portions 16*a* also arranged in that pattern.

Figure 24:
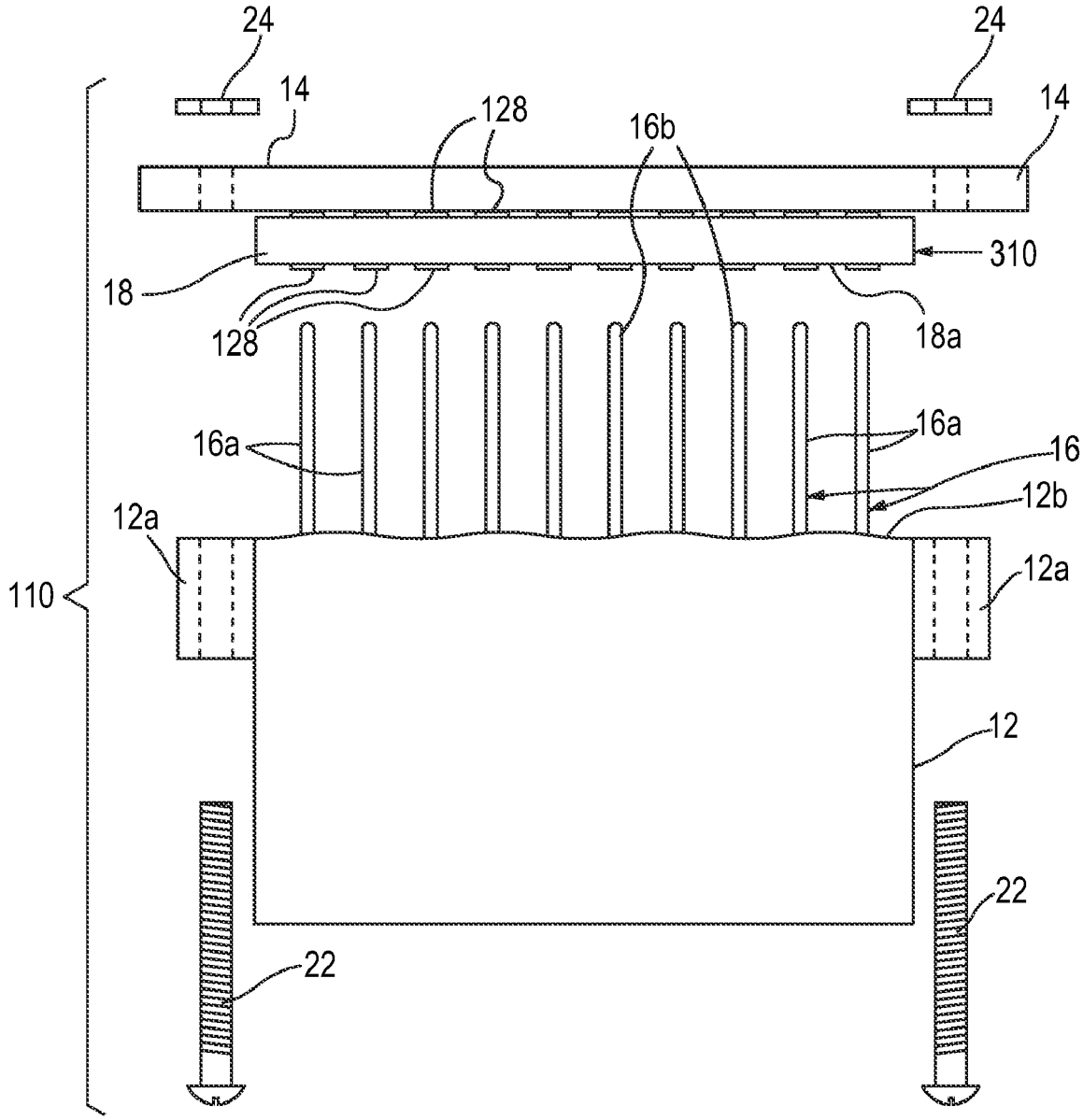
FIG. 24 is a diagrammatical view of an electrical connector assembly with the electrical connector housing, the printed circuit board and the third exemplary embodiment of the dielectric part disposed therebetween and aligned for connecting the same together and with the dielectric part being in a normally relaxed state.
Figure 25:
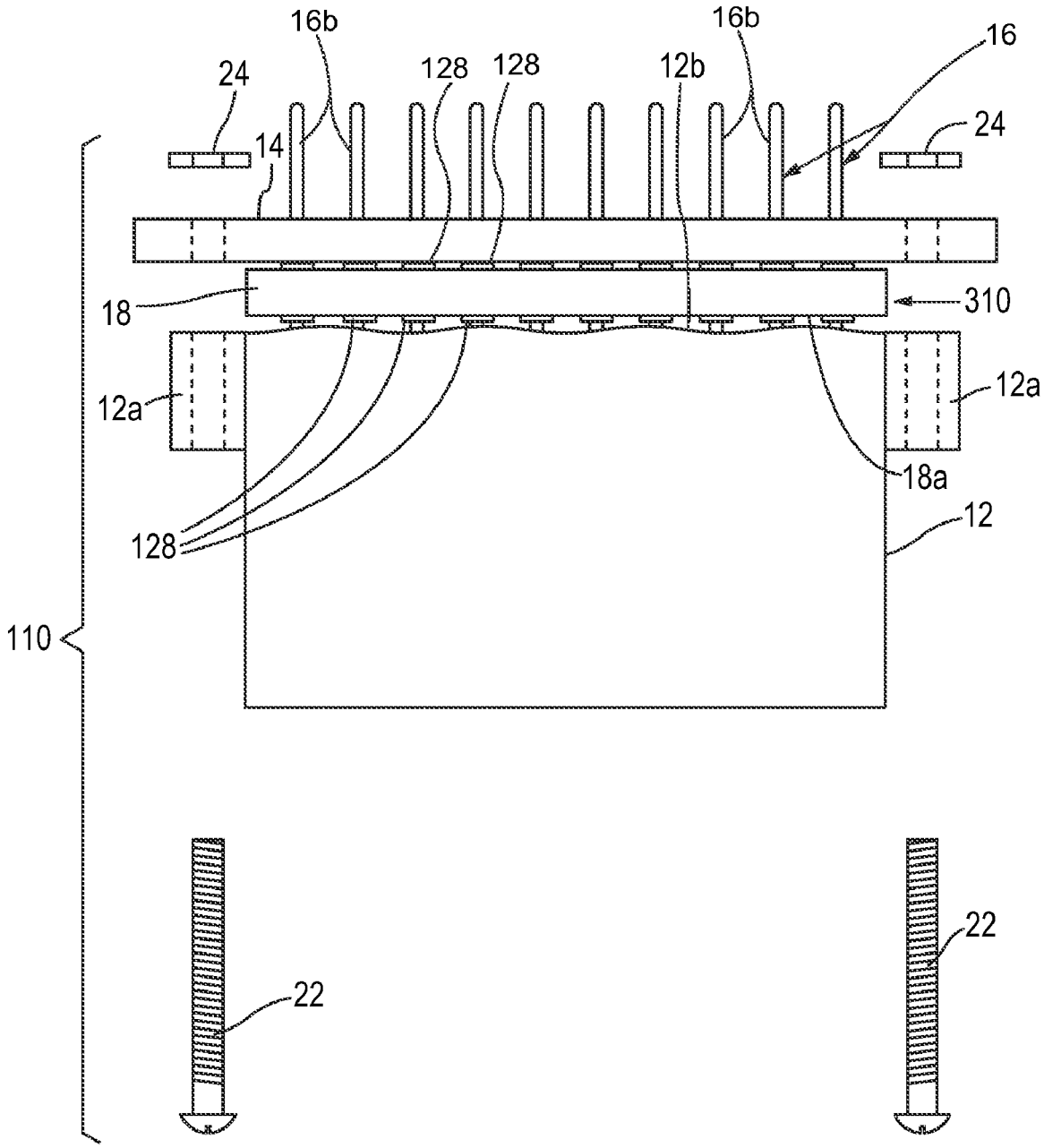
FIG. 25 is a diagrammatical view of the electrical connector assembly with the electrical connector housing, the printed circuit board and the third exemplary embodiment of the dielectric part disposed therebetween and in contact with both the electrical connector housing and the printed circuit board aligned for connecting the same together and with the dielectric part being in the normally relaxed state.
Figure 26:
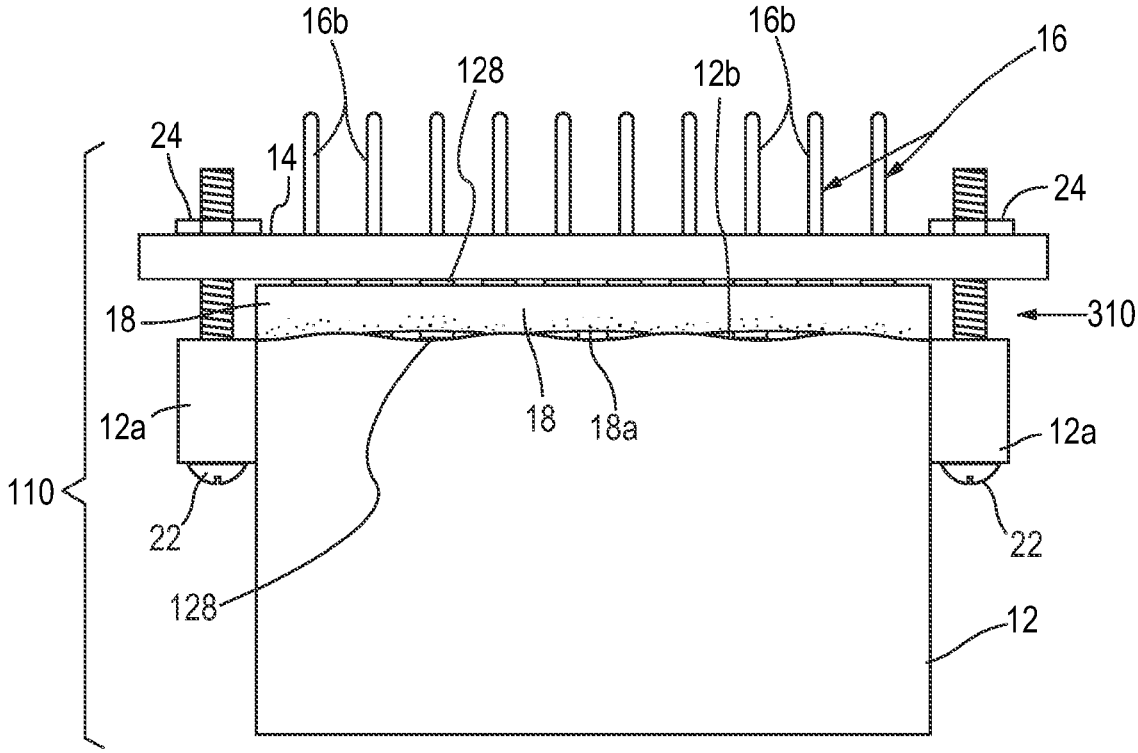
FIG. 26 is a diagrammatical view of the electrical connector assembly with the electrical connector housing, the printed circuit board and the third exemplary embodiment of the dielectric part disposed therebetween and connected together and with the dielectric part being in the compressed state.

A third exemplary embodiment of a dielectric part 310 of the present invention is introduced in FIGS. 19-26. The third exemplary embodiment of the dielectric part 310 is similar to the second exemplary embodiment of the dielectric part 210 described above. The differences are that each one of the ring-shaped projections 128 is rectangularly-shaped as shown in cross-section in FIGS. 19-23. Another difference is that the ring-shaped projections 128 are formed on both the first dielectric part body surface 18*a* and the second dielectric part body surface 18*b* as best shown in FIGS. 20-26. When the dielectric part 310 and the printed circuit board 14 are connected together as illustrated in FIG. 24, the ring-shaped projections 128 on the second dielectric part body surface 18*b* are contacted and compressed by the printed circuit board 14.

Figure 27:
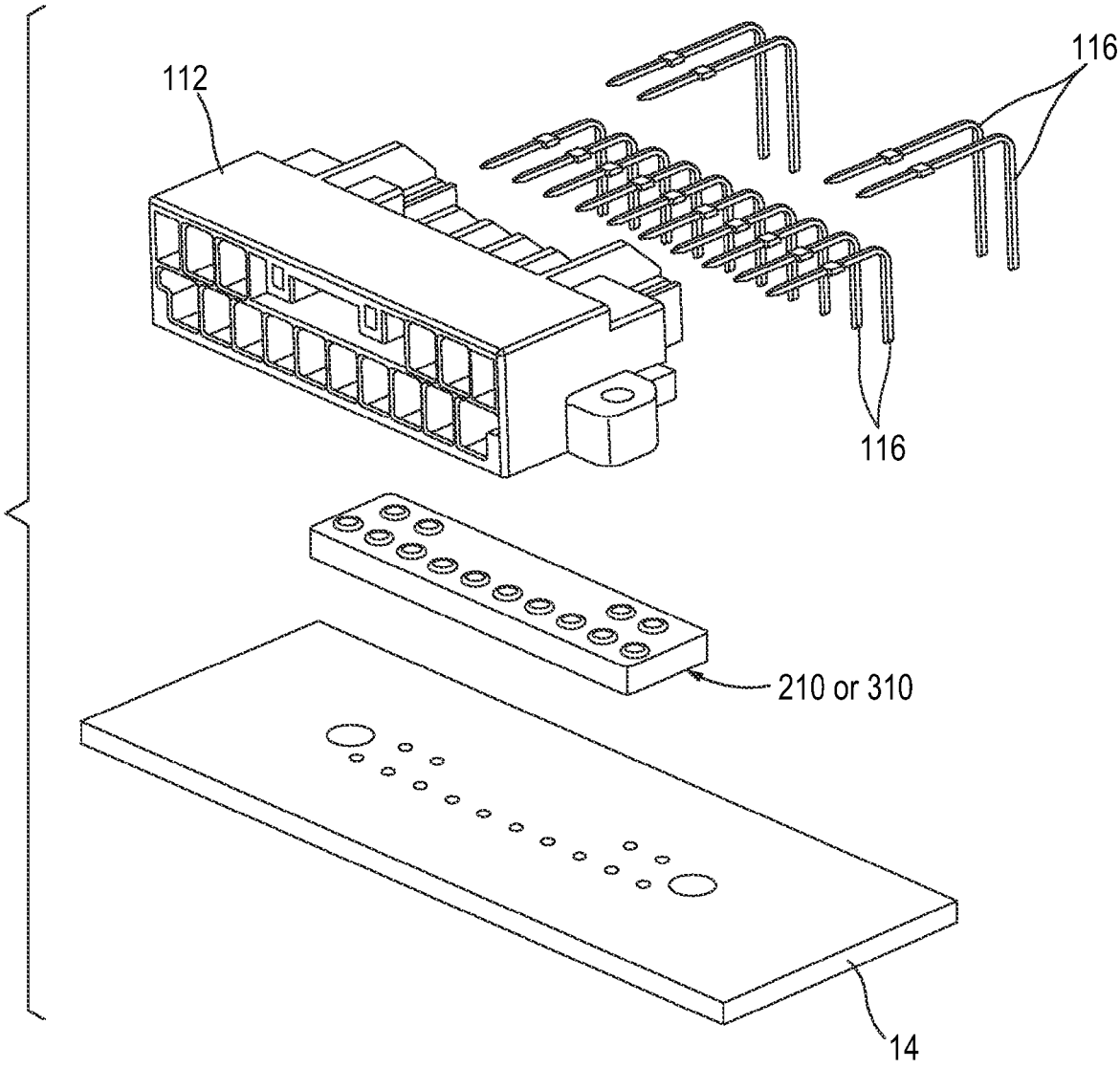
FIG. 27 is an exploded perspective view of another type of electrical connector assembly that includes the dielectric part of the present invention, another type of an electrical connector housing that secures therein a plurality of 90-degree bent terminal pins and the printed circuit board.

FIG. 27 illustrates that the dielectric part 10, 210 or 310 can be employed with another type of electrical connector housing 112. The electrical connector housing 112 secures bent terminal pins 116 that are bent at a 90-degree angle.

A skilled artisan would appreciate that the dielectric part of the present invention that is employed with an electrical connector assembly provides enhanced dielectric characteristics of the same and mitigates electrical arching between juxtaposed ones of terminal pins projecting from the electrical connector housing of the electrical connector assembly.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art. For example, although the exemplary embodiments of the present invention illustrate a male electrical connector housing, one of ordinary skill in the art would appreciate that the dielectric part might be incorporated with a female electrical connector housing. Also, the dielectric part might also be fabricated from a dielectric material that is compressible such as a stiff yet resilient material like some types of resin or plastic. Further, in addition to the shapes of the electrical connector housings described herein, other shapes and types of electrical connector housings might be employed with the present invention.

What is claimed is:

1. A dielectric part adapted for use with an electrical connector housing and a matable connector piece, the electrical connector housing having a plurality of terminal pins secured therein with terminal pin portions extending from the electrical connector housing, the dielectric part comprising:

a box-shaped dielectric part body fabricated from a compressible dielectric material and having a plurality of dielectric part body holes sized and arranged to slidably receive respective ones of the terminal pin portions such that when the electrical connector housing and the matable connector piece are releasably connected together, the dielectric part body is disposed and compressed between at least a portion of the electrical connector housing and the matable connector piece and respective ones of the terminal pin portions are slidably received in respective ones of the plurality of dielectric part body holes and fully enveloped by the dielectric part body between the electrical connector housing and the matable connector piece to isolate and thus electrically insulate the terminal pin portions from one another and end sections of the terminal pin portions extend through and project from the matable connector piece, wherein the dielectric part body has a first dielectric part body surface and an opposite second dielectric part body second surface extending parallel to the first dielectric part body surface, the dielectric part body holes extending through and between the first dielectric part body surface and the second dielectric part body surface and wherein the dielectric part body includes a plurality of projections connected to and projecting from at least one of the first and second dielectric part body surfaces, respective ones of the plurality of projections surrounding respective ones of the dielectric part body holes and wherein at least the plurality of projections are compressed when the electrical connector housing and the matable connector piece are releasably connected together.

2. A dielectric part according to claim 1, wherein each one of the plurality of projections is ring-shaped and defines a ring-shaped projection hole.

3. A dielectric part according to claim 2, wherein each one of the dielectric part body holes has a dielectric part body hole diameter and each one of the ring-shaped projection holes has an inner ring-shaped projection hole diameter equal to the dielectric part body hole diameter.

4. A dielectric part according to claim 3, wherein respective ones of the dielectric part body holes and respective ones of the inner ring-shaped projection holes axially align with one another.

5. A dielectric part according to claim 1, wherein each one of the ring-shaped projections is arcuately shaped as shown in cross-section.

6. A dielectric part according to claim 1, wherein each one of the ring-shaped projections is rectangularly-shaped as shown in cross-section.

7. A dielectric part according to claim 1, wherein the dielectric part body and the plurality of projections are formed as an integral construction.

8. A dielectric part, comprising:

a box-shaped dielectric part body fabricated from a compressible dielectric material and having a first dielectric part body surface and an opposite second dielectric part body second surface extending parallel to the first dielectric part body surface, the dielectric part body having a plurality of dielectric part body holes extending through and between the first dielectric part body surface and the second dielectric part body surface and a plurality of projections connected to and projecting from at least one of the first and second dielectric part body surfaces, respective ones of the plurality of projections surrounding respective ones of the dielectric part body holes, wherein each one of the plurality of projections is ring-shaped defining a ring-shaped projection hole, wherein each one of the dielectric part body holes has a dielectric part body hole diameter and each one of the ring-shaped projection holes has an inner ring-shaped projection hole diameter equal to the dielectric part body hole diameter and wherein, upon applying a compression force to the dielectric part body, at least the plurality of projections are compressed.

9. A dielectric part according to claim 8, wherein respective ones of the dielectric part body holes and respective ones of the inner ring-shaped projection holes axially align with one another.

10. A dielectric part according to claim 8, wherein each one of the ring-shaped projections is arcuately shaped as shown in cross-section.

11. An electrical assembly, comprising:

a matable connector piece;

an electrical connector housing with a plurality of terminal pins secured therein with terminal pin portions extending from the electrical connector housing; and a dielectric part having a box-shaped dielectric part body fabricated from a compressible dielectric material and a plurality of dielectric part body holes sized and arranged to slidably receive respective ones of the terminal pin portions in a close-fitting relationship such that when the electrical connector housing and the matable connector piece are releasably connected together, the dielectric part body is disposed and compressed between at least a portion of the electrical connector housing and the matable connector piece and respective ones of the terminal pin portions are slidably received in respective ones of the plurality of dielectric part body holes are fully enveloped by the dielectric part body between the electrical connector housing and the matable connector piece to isolate and thus electrically insulate the terminal pin portions from one another and end sections of the terminal pin portions extend through and project from the matable connector piece, wherein, the dielectric part moves to and between a normally relaxed state and a compressed state with the dielectric part being resiliently biased towards the normally relaxed state and, when the electrical connector housing and the matable connector piece are connected together, the dielectric part moves from the normally relaxed state to the compressed state, wherein the dielectric part body has a first dielectric part body surface and an opposite second dielectric part body second surface extending parallel to the first dielectric part body surface, the dielectric part body holes extending through and between the first dielectric part body surface and the second dielectric part body surface, wherein the dielectric part body includes a plurality of projections connected to and projecting from at least one of the first and second dielectric part body surfaces as an integral construction, respective ones of the plurality of ring-shaped projections surrounding respective ones of the dielectric part body holes with each one of the plurality of ring-shaped projections defining a ring-shaped projection hole and wherein at least the plurality of projections are compressed when the electrical connector housing and the matable connector piece are releasably connected together.

12. An electrical assembly according to claim 11, wherein, in the compressed state, at least the plurality of ring-shaped projections are in contact with and are compressed by the electrical connector housing connected to the matable connector piece.

13. An electrical assembly according to claim 11, wherein each one of the dielectric part body holes has a dielectric part body hole diameter and each one of the ring -shaped projection holes has an inner ring-shaped projection hole diameter equal to the dielectric part body hole diameter and respective ones of the dielectric part body holes and respective ones of the inner ring-shaped projection holes axially align with one another.

14. An electrical assembly according to claim 11, wherein each one of the ring-shaped projections is arcuately shaped as shown in cross-section.

* * * * *